US008646737B1

(12) United States Patent
Sharpless

(10) Patent No.: US 8,646,737 B1
(45) Date of Patent: Feb. 11, 2014

(54) HOLDING DEVICE FOR HOLDING THE BOTTOM OF A BUCKET WHILE MIXING MATERIALS WITHIN THE BUCKET

(76) Inventor: S. Robert Sharpless, Devon, PA (US)

( * ) Notice: Subject to any disclaimer, the term of this patent is extended or adjusted under 35 U.S.C. 154(b) by 23 days.

(21) Appl. No.: 13/310,682

(22) Filed: Dec. 2, 2011

(51) Int. Cl.
*A47G 23/02* (2006.01)

(52) U.S. Cl.
USPC ..... 248/154; 248/346.03; 248/346.5; 108/55.1

(58) Field of Classification Search
USPC ..... 366/129, 349; 248/109, 154, 346.01, 248/346.03, 346.07, 346.5, 907; 108/55.1, 108/55.3
See application file for complete search history.

(56) References Cited

U.S. PATENT DOCUMENTS

| | | | | |
|---|---|---|---|---|
| 466,895 | A * | 1/1892 | Perkins | 15/259 |
| 807,613 | A * | 12/1905 | Graves | 81/3.32 |
| 1,260,157 | A * | 3/1918 | Denton | 165/80.1 |
| 1,598,135 | A * | 8/1926 | Heinson et al. | 220/813 |
| 3,820,750 | A * | 6/1974 | Deike | 248/154 |
| D419,414 | S | 1/2000 | Pellak | |
| 6,375,134 | B1 * | 4/2002 | Goldschmidt et al. | 248/154 |
| 6,829,800 | B2 * | 12/2004 | Roebuck | 7/151 |
| 7,258,312 | B2 * | 8/2007 | Grosse | 248/154 |
| 7,261,262 | B2 | 8/2007 | Dunson | |
| 7,494,097 | B2 * | 2/2009 | Lidie et al. | 248/126 |
| 7,494,103 | B1 * | 2/2009 | Huebner | 248/346.07 |
| 8,011,701 | B2 * | 9/2011 | Taylor | 292/256 |
| 8,256,731 | B2 * | 9/2012 | Wickwire | 248/346.07 |
| 2003/0106158 | A1 | 6/2003 | Roebuck | |
| 2006/0209622 | A1 | 9/2006 | Kennedy | |
| 2007/0076519 | A1 * | 4/2007 | Kesling | 366/129 |
| 2007/0280043 | A1 * | 12/2007 | Cintorino | 366/215 |
| 2008/0042035 | A1 * | 2/2008 | Elwood | 248/346.03 |
| 2011/0198457 | A1 * | 8/2011 | Rauchut | 248/154 |
| 2012/0168591 | A1 * | 7/2012 | Cimaglio | 248/346.04 |

* cited by examiner

*Primary Examiner* — Bradley Duckworth
(74) *Attorney, Agent, or Firm* — LaMorte & Associates, P.C.

(57) ABSTRACT

A holding device for use when mixing materials in a bucket. The holding device has a support base with a flat bucket placement area. At least one vertical guide extends upwardly from the support base, along a periphery of the bucket placement area. A locking cam is provided that is connected to the support base with a pivot connection. The pivot connection enables the locking cam to rotate in a plane parallel to the support base from a first position that is outside the bucket placement area to a second position that is at least in part within the bucket placement area. When a bucket is placed upon the flat bucket support base, the locking cam is out of the way. Once the bucket is positioned, the locking cam is rotated until the locking cam engages the exterior of the bucket and prevents the bucket from spinning.

17 Claims, 4 Drawing Sheets

HOLDING DEVICE FOR HOLDING THE BOTTOM OF A BUCKET WHILE MIXING MATERIALS WITHIN THE BUCKET

BACKGROUND OF THE INVENTION

1. Field of the Invention

In general, the present invention relates to holding devices and mechanisms that can receive and engage the exterior of a bucket or similar receptacle. More particularly, the present invention relates to holding devices and mechanisms that prevent a bucket from moving while materials are mixed within the bucket.

2. Prior Art Description

People use buckets for countless purposes other than to just hold water. For example, construction workers, masons and the like often use buckets to mix small batches of cement or mortar. Lawn care professionals often mix seeds, fertilizers and chemicals in buckets. Furthermore, many commercial products, such as paint, are sold in buckets.

The use of a bucket enables a person to mix materials together within the confines of the bucket without losing any of the material. Although the contents of a bucket can be mixed by hand, many people mix the contents of a bucket using some power tool, such as a power drill that is attached to a blade mixer. For example, U.S. Pat. No. D 419,414 to Pellack, entitled Cement Mixing Attachment For A Power Drill, shows a blade mixer that enables concrete to be mixed within the confines of a five gallon bucket using a power drill.

Although the use of power tools does make the mixing of a bucket's contents easier, it does have certain drawbacks. Many materials, such as cement mixes, mortar mixes, sand mixes, and the like are extremely dense and/or viscous. As such, they resist being mixed. Accordingly, a power tool with an exceptionally strong motor must be used to mix this material within the confines of a bucket. Due to the high viscosity of the material being mixed and the power of the mixing tool, it is easier for the mixing tool to spin the entire bucket of material than it is for the mixing tool to spin just the contents of the bucket. Consequently, in order for the contents of the bucket to be mixed, the bucket must be held stationary during the mixing process.

When materials are mixed in a bucket using a power tool, it commonly requires both hands of the operator to run the power tool. Accordingly, the operator has no free hand to hold the bucket still during mixing. As a result, the operator commonly attempts to hold the bucket still using his/her feet. This places the operator off-balance and offers little resistance to the bucket. A common result is that the bucket still moves and the operator falls.

In order to improve the resistance between an operator's foot and the turning bucket, a variety of holding devices have been developed in the prior art that extends between an operator's foot or leg and the bucket. Such prior art holding devices are exemplified by U.S. Pat. No. 7,261,262 to Dunson, entitled Bucket Brace And Method Of Use; U.S. Patent Application Publication No. 2006/0209622 to Kennedy, entitled Holding Apparatus For Buckets; and U.S. Patent Application No. 2003/0106158 to Roebuck, entitled Bucket Grasp For Spin Resistive Mixing.

A problem associated with such prior art holding devices is one of safety to the operator. In such prior art holding devices, the operator is required to place one leg in a specific position near the bucket. This may cause the operator to become off balance. If the holding device slips away from the leg, it can spin with the bucket at great speed and impact the user's leg. This can easily cause a severe injury. Furthermore, the impact to the leg can easily cause the operator to fall, therein providing the potential for secondary injuries.

A need therefore exists for a holding device that can safely engage the exterior of a bucket while the contents of the bucket are mixed, wherein the engagement mechanism is not anchored by the leg or foot of the user. This need is met by the present invention as described and claimed below.

SUMMARY OF THE INVENTION

A bucket holding device for use when mixing materials in a bucket. The bucket holding device has a support base with a flat bottom surface and a flat bucket placement area. At least one vertical guide extends upwardly from the support surface, along a periphery of the bucket placement area. A first locking cam is provided that is connected to the support base with a pivot connection. The pivot connection enables the locking cam to rotate in a plane parallel to the bottom surface from a first position that is outside the bucket placement area to a second position that is at least in part within the bucket placement area.

When a bucket is placed upon the flat bucket placement area, the locking cam is out of the way. Once the bucket is positioned, the locking cam is rotated until the locking cam engages the exterior of the bucket. When material is mixed in the bucket, the bucket begins to spin. The movement of the bucket causes the locking cam to press harder against the bucket and bias the bucket against the vertical guide. The result is that the bucket becomes locked in place atop the bucket holding device. The bucket holding device itself is prevented from moving by affixing the bucket holding device to an underlying surface with one or more mechanical fasteners.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention holding device can be embodied in many ways to engage different types of buckets, the embodiment illustrated shows the holding device being used to receive and retain a five gallon bucket. This embodiment is selected in order to set forth the best mode contemplated for the invention. The illustrated embodiment, however, is merely exemplary and should not be considered a limitation when interpreting the scope of the appended claims.

Figure 1:
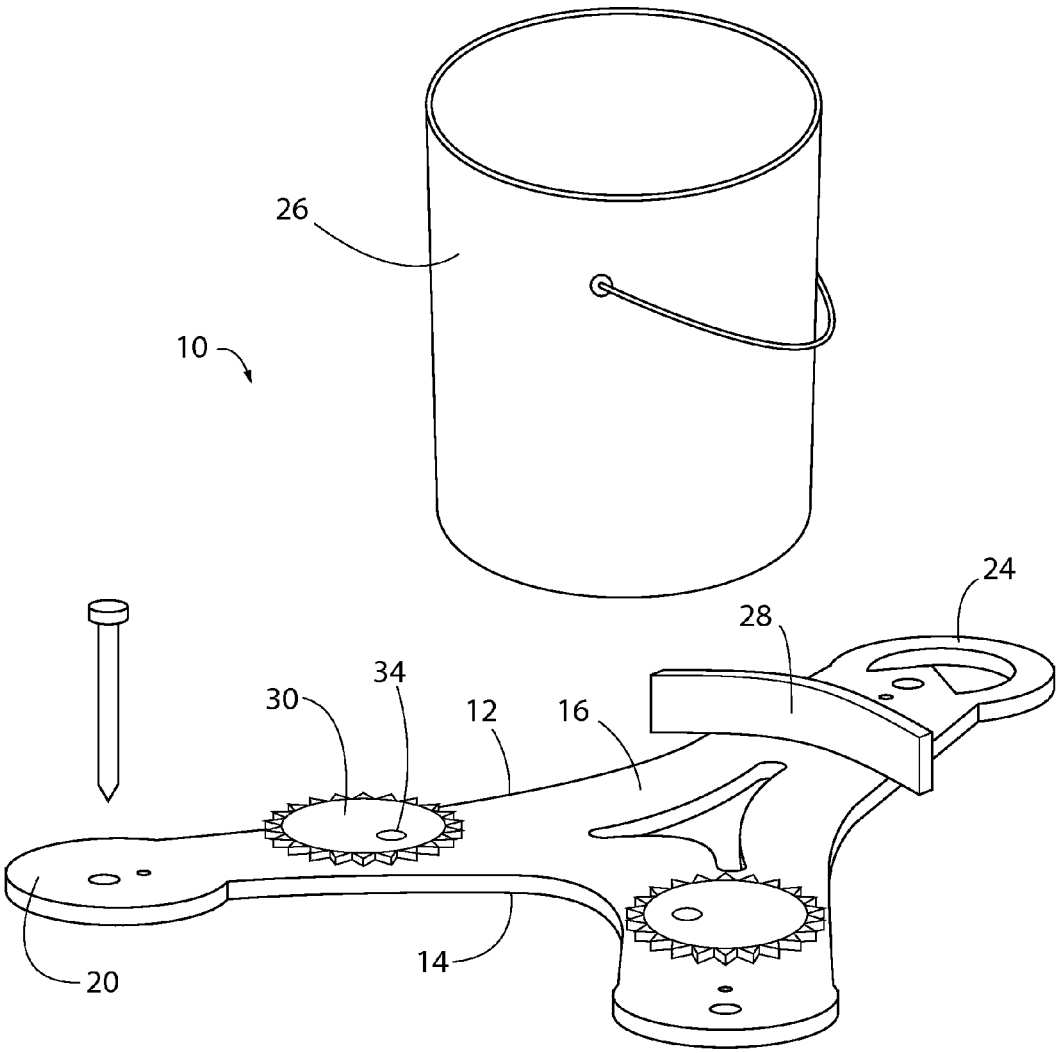
FIG. 1 is a perspective view of an exemplary embodiment of a holding device shown in conjunction with a bucket.
Figure 2:
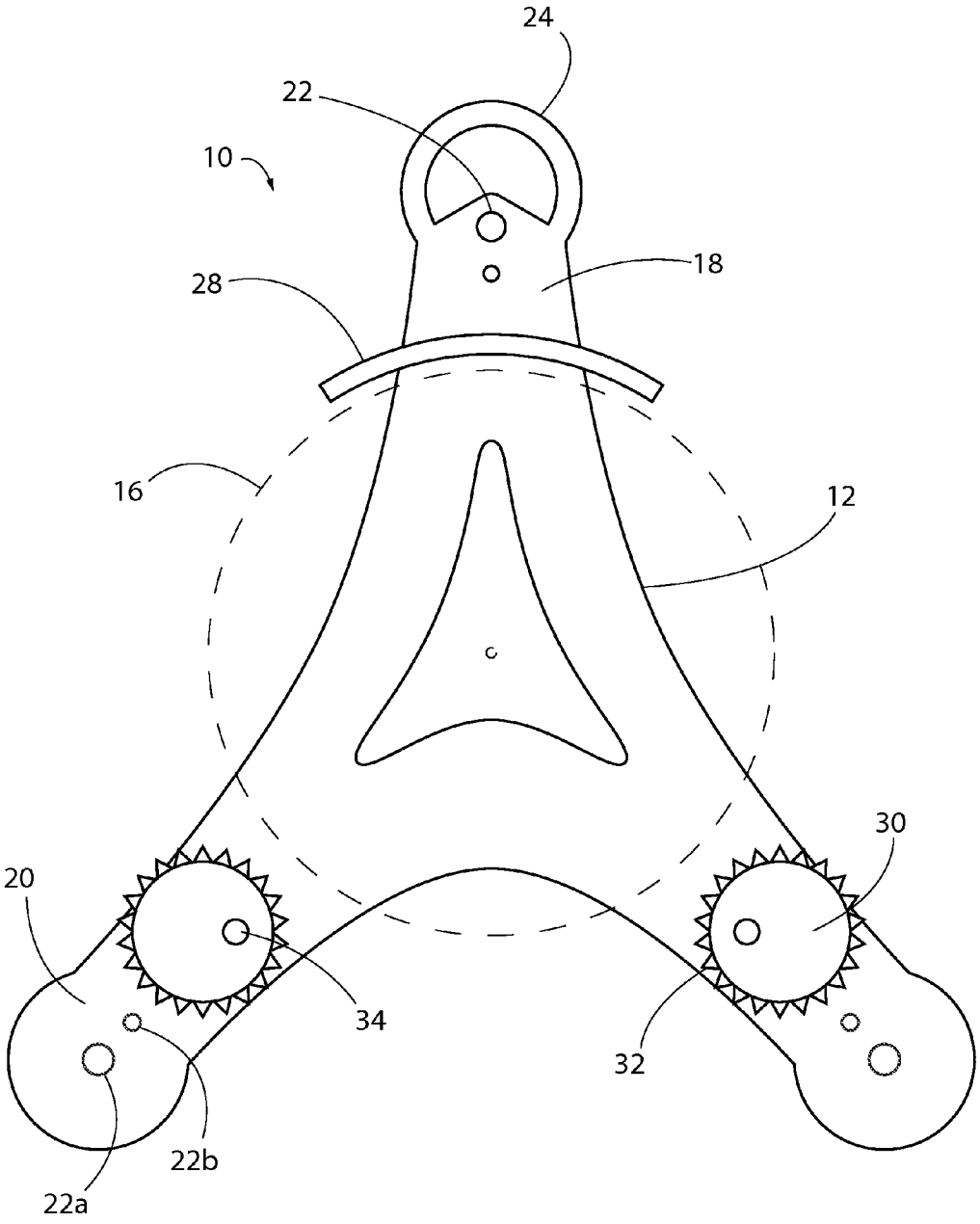
FIG. 2 is a top view of the holding device.

Referring to FIG. 1 in conjunction with FIG. 2, it can be seen that present invention holding device 10 includes a support base 12. The support base 12 has a flat bottom surface 14 on one side that faces down, and a flat bucket support area 16 on the opposite side that faces up. The support base 12 can be made of plastic or plywood. However, in the preferred embodiment, the support base 12 is made of steel sheet metal having a gauge thickness of at least $1/32^{nd}$ of an inch.

The support base 12 is configured to have salient arms 18 that interconnect. In the illustrated embodiment, three salient arms 18 are shown. This is a minimum configuration. It should be understood that four or more salient arms can be used. All of the salient arms 18 terminate with head sections 20. Each of the head sections 20 has mounting holes 22 that pass through the material of the support base 12. In the shown embodiment, the mounting holes 22 are provided in sets that include a large hole 22*a* and a small hole 22*b*. The small holes 22*b* enable screws or nails to secure the support base 12 to an underlying sheet of plywood or spare pieces of framing lumber. The large mounting holes 22*a* enable the support base 12 to be spiked to the earth or bolted to a floor, using an appropriate mechanical fastener.

In the shown embodiment, an optional carry handle 24 is shown at the head section 20 of one of the salient arms 18. The carry handle 24 is slightly bent up out of the primary plane of the support base 12 so it is easy to grasp and lift.

The support base 12 has a flat bucket support area 16 around which the various salient arms 18 are positioned. The flat bucket support area 16 has a center point CP, wherein the flat bucket support area 16 extends in a circle about said center point, having a radius of between four inches and seven inches. When a bucket 26 is placed on the holding device 10, the bottom of the bucket is placed atop the flat bucket support area 16. A five gallon bucket has a base radius R1 that is typically between four inches and six inches, depending upon the manufacturer. A guide wall 28 or similar guide element is affixed to the top of the support base 12 atop at least one of the salient arms 18. The guide wall 28 has a radius R2 that positions the guide wall 28 proximate the exterior of the bucket 26 when the bucket 26 is placed atop the support base 12.

Figure 3:
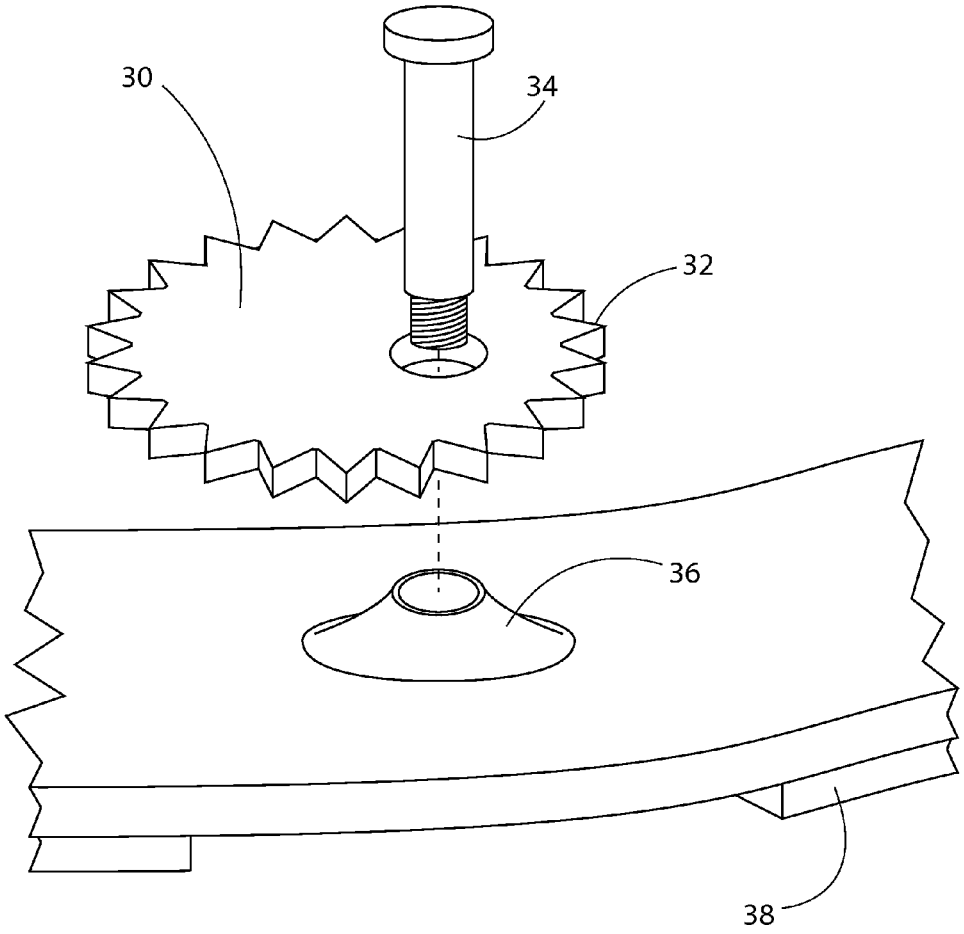
FIG. 3 is a fragmented view of a portion of the holding device that contains a locking cam.

Referring to FIG. 3 in conjunction with FIG. 1 and FIG. 2, it can be seen that a locking cam 30 is provided on at least one of the salient arms 18. The locking cam 30 has peripheral teeth 32. The teeth 32 are pointed to engage the exterior of a bucket 26 with a high degree of friction. The locking cam 30 is eccentrically mounted to the support base 12 using a pivot bolt 34. A spacer projection 36 is formed in the material of the support base 12. The pivot bolt 34 passes through the center of the spacer projection 36, wherein the pivot bolt 34 interconnects the locking cam 30 to the support base 12. Due to the presence of the spacer projection 36, the locking cam 30 is elevated a short distance above the primary plane of the flat bucket support area 16 in a parallel plane. This short distance is preferably between ¼ inch and 2 inches. The pivot bolt 34 passes through both the locking cam 30 and the spacer projection 36. However, the locking cam 30 is free to rotate about the pivot bolt 34.

The pivot bolt 34 passes through the locking cam 30 off center from the middle of the locking cam 30. Accordingly, it should be understood that the distance D1 between the center of the locking cam 30 and the center point of the flat bucket support area 16 varies as the locking cam 30 rotates about the pivot bolt 34. The eccentric mounting of the locking cam 30 enables the locking cam 30 to be rotated either completely outside the flat bucket support area 16 or partially within the flat bucket support area 16.

Figure 4:
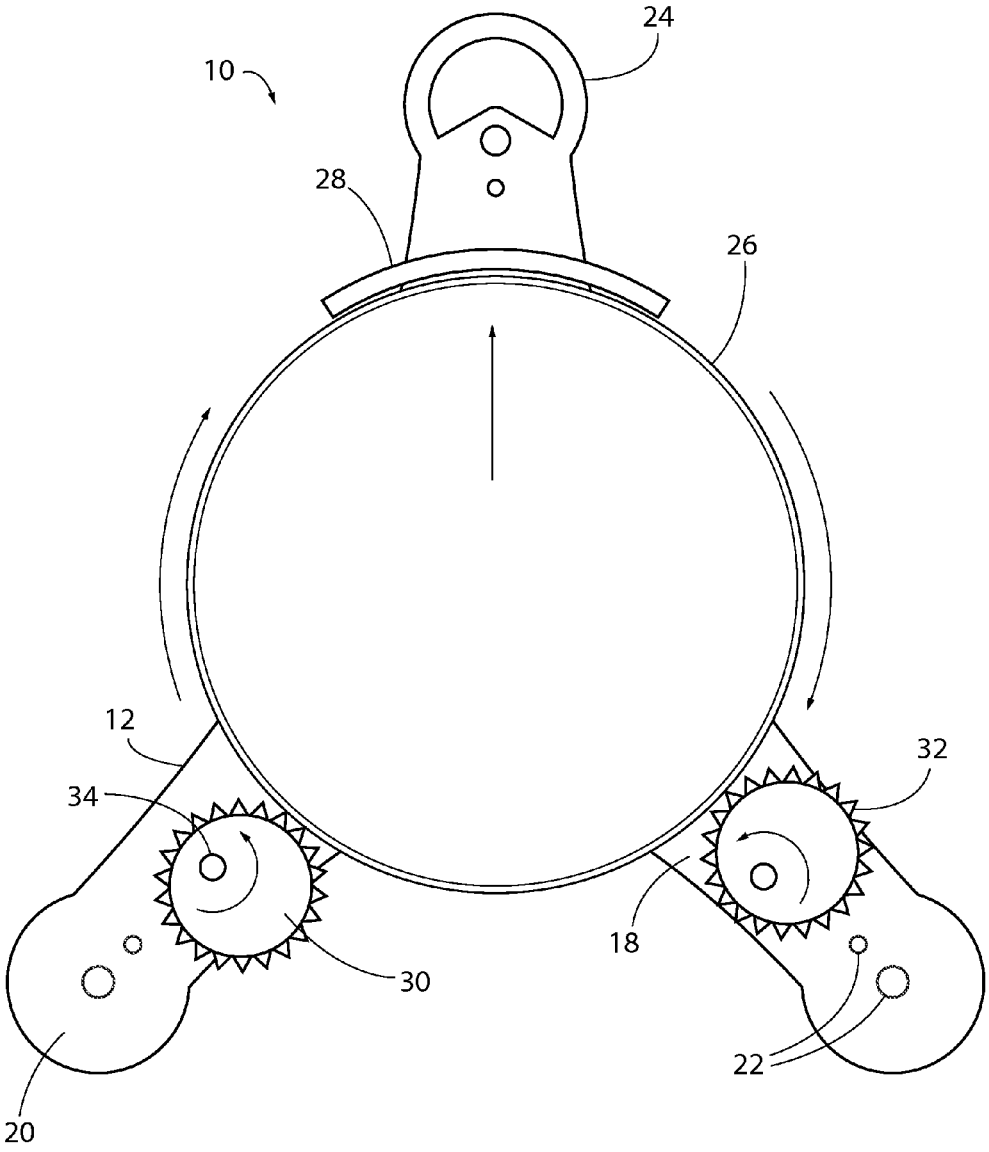
FIG. 4 is a top view of the holding device shown holding a bucket.

Referring now to FIG. 4, it will be understood that in order to use the present invention holding device 10, the support base 12 is placed on a flat surface. The support base 12 can be affixed to the flat surface by driving an appropriate mechanical fastener through some of the mounting holes 22. If the support base 12 is placed on a surface that cannot be pierced, the user can stand in a balanced position upon the support base 12 by placing his/her feet in the head sections 20 of two of the salient arms 18.

A bucket 26 is placed upon the flat bucket support area 16 in the center of the support base 12. The bucket 26 is shifted along the flat bucket support area 16 until the bucket 26 is brought into contact with the guide wall 28. If the bucket 26 is properly sized, the bucket will automatically abut against the locking cams. If the bucket is a little under sized, then the locking cams 30 can be rotated either in a clockwise direction or a counter-clockwise direction until the teeth on the locking cams 30 contact the exterior of the bucket 26. If the contents of the bucket 26 are going to be mixed in a clockwise direction, then the locking cams 30 are rotated in a counterclockwise direction in order to engage the bucket 26. This configuration is illustrated in FIG. 4. As a consequence, the clockwise rotation of the contents of the bucket 26 will bias the bucket 26 into a corresponding clockwise rotation. This clockwise rotation of the bucket 26 increases the contact between the bucket 26 and the teeth 32 of the locking cams 30. The locking cams 30, therefore, are biased in the counterclockwise direction and increasingly press the bucket 26 towards the guide wall 28. The rotation of the bucket 26 therefore causes the bucket 26 to become locked in place between the guide wall 28 and the locking cams 30.

If the bucket 26 is undersized and the contents of the bucket 26 are going to be rotated in a counterclockwise direction, the locking cams 30 would be rotated in a clockwise direction until they engage the bucket 26. In this manner, the rotational bias of the bucket 26 would acts to increase the engagement between the locking cams 30 and the exterior of the bucket 26.

Once the bucket 26 is engaged by the teeth 32 on the locking cams 30 the bucket 26 is locked in place. The contents of the bucket 26 can then be safely mixed without the bucket 26 moving. Due to the mechanical advantage inherent in the orientation of the locking cams 30, relative the bucket 26, the force resisting the rotation of the bucket 26 will always be greater than the rotational forces trying to rotate the bucket 26. Accordingly, the bucket 26 will remain locked in place regardless of the amount of force used to mix the contents of the bucket 26.

The bucket 26 locks with the holding device 10. The holding device 10 is prevented from rotating with the bucket 26 by the mechanical fasteners that connect the holding device 10 to the underlying surface. If the holding device 10 is set on a finished floor, a concrete floor or some other floor that cannot be engaged with a mechanical fastener, then optional rubber pads 38 can be adhered to the bottom surface of the support base 12. The pads 38 make a high friction contact with the underlying floor. The user stands on the support base 12 with a balanced stance to increase the friction and to ensure no movement of the either the holding device 10 or the bucket 26 it holds.

To remove the bucket 26 from the holding device 10, the bucket 26 is simply manually rotated in the direction opposite the mixing direction. This rotational movement causes the locking cams 30 to rotate away from the bucket 26 to a point where the teeth 32 disengage the bucket 26. The bucket 26 is then free to be removed.

It will be understood that the embodiment of the present invention that is illustrated and described is merely exemplary and that a person skilled in the art can make many variations to that embodiment. For instance, the number and positions of the salient arms can be varied. The number of locking cams can be varied, the size of the locking cams can be varied. All such embodiments are intended to be included within the scope of the present invention as defined by the claims.

What is claimed is:

1. A bucket holding device for use when mixing materials in a bucket, said device comprising:

a support base having at least a first salient arm, a second salient arm and a third salient arm that radially extends from a common central point, said support base having a flat bottom surface on one side and a flat bucket placement area on an opposite side, wherein said flat bucket placement area is a centered about said common central point, and wherein said first salient arm, said second salient arm and said third salient arm all extend beyond said flat bucket placement area;

at least one vertical guide extending upwardly from said first salient arm of said support base, outside of said flat bucket placement area; and a first locking cam connected to said second salient arm of said support base, outside of said flat bucket placement area with a pivot connection, wherein said pivot connection enables said locking cam to rotate in a plane parallel to said bottom surface from a first position that is outside said bucket placement area to a second position that is at least partially within said bucket placement area.

2. The holding device according to claim 1, further including a second locking cam connected, outside of said flat bucket placement area to said third salient arm of said support base with a second pivot connection, wherein said second pivot connection enables said second locking cam to rotate in a plane parallel to said bottom surface from a first position that is outside said bucket placement area to a second position that is at least partially within said bucket placement area.

3. The device according to claim 1, further including mounting holes formed through said first salient arm, said second salient arm and said third salient arm of said support base that enable mechanical fasteners to extend through said support base.

4. The device according to claim 1, wherein said support base is made of steel.

5. The device according to claim 1, wherein said first locking cam has extending teeth.

6. The device according to claim 1, wherein said first locking cam is elevated a predetermined distance above said flat bucket placement area.

7. The device according to claim 1, wherein said predetermined distance is between ¼ inch and 2 inches.

8. The device according to claim 1, wherein said at least one vertical guide includes a curved guide wall.

9. The device according to claim 1, wherein said first salient arm, said second salient arm and said third salient arm are symmetrically disposed about said common central point of said support base.

10. The device according to claim 1, further including at least some high friction material adhered to said bottom surface of said support base.

11. The device according to claim 1, wherein said flat bucket placement area is a circular area having a radius of between four inches and six inches.

12. A device for holding a bucket stationary while materials are mixed within said bucket, said device comprising:

a support base having at least a first salient arm, a second salient arm and a third salient arm that radially extend beyond a flat bucket placement area;

at least one vertical guide extending upwardly from said first salient arm of said support base, outside of said flat bucket placement area; and a locking cam connected to said second salient arm of said support base, outside of said flat bucket placement area, wherein said locking cam is rotatable between a first position that is outside of said flat bucket placement area and a second position that is at least partially within said bucket placement area.

13. The device according to claim 12, wherein said locking cam is a toothed wheel that is connected to said support base with a pivot connection, wherein said pivot connection extends through said locking cam at an eccentric point on said locking cam.

14. The device according to claim 12, further including mounting holes formed through said support base that enable mechanical fasteners to extend through said support base.

15. The device according to claim 12, wherein said locking cam is elevated a predetermined distance above said flat bucket placement area.

16. The device according to claim 15, wherein said predetermined distance is between ¼ inch and 2 inches.

17. The device according to claim 12, wherein said at least one vertical guide includes a curved guide wall.

* * * * *